US005569142A

United States Patent [19]

Snellman

[11] Patent Number: 5,569,142

[45] Date of Patent: Oct. 29, 1996

[54] CENTER ROLL IN THE PRESS OF A PAPER MACHINE

[75] Inventor: Jorma Snellman, Jyväskylä, Finland

[73] Assignee: Valmet Corporation, Helsinki, Finland

[21] Appl. No.: 443,467

[22] Filed: May 18, 1995

Related U.S. Application Data

[62] Division of Ser. No. 249,844, May 26, 1994, Pat. No. 5,456,946, which is a continuation of Ser. No. 46,458, Apr. 12, 1993, abandoned.

[30] Foreign Application Priority Data

Apr. 14, 1992 [FI] Finland ..... 921680

[51] Int. Cl.[6] ..... B23P 15/00

[52] U.S. Cl. ..... 492/56; 492/20; 492/30; 492/35

[58] Field of Search ..... 492/30, 35, 20, 492/56, 59; 29/895, 895.32

[56] References Cited

U.S. PATENT DOCUMENTS

| | | | |
|---|---|---|---|
| 2,288,675 | 7/1942 | Berry | 492/30 |
| 3,852,861 | 10/1974 | Baker et al. | 29/132 |
| 3,942,230 | 3/1976 | Nalband | 29/132 |
| 4,518,460 | 5/1985 | Hauser et al. | 492/30 |
| 4,559,106 | 12/1985 | Skytta et al. | 492/30 |
| 4,693,784 | 9/1987 | Aula et al. | 492/30 |
| 4,951,392 | 8/1990 | Miihkinen | 29/895.211 |
| 5,023,985 | 6/1991 | Salo et al. | 29/132 |
| 5,056,220 | 10/1991 | Telama | 29/895.32 |
| 5,065,193 | 11/1991 | Saitoh et al. | 29/895 |
| 5,111,567 | 5/1992 | Leino et al. | 29/132 |
| 5,111,568 | 5/1992 | Telama | 29/132 |
| 5,138,766 | 8/1992 | Kimura et al. | 29/895.212 |
| 5,186,849 | 2/1993 | Kobayashi | 29/895.32 |
| 5,188,273 | 2/1993 | Schmoock | 492/30 |
| 5,257,966 | 11/1993 | Watanabe et al. | 492/37 |

FOREIGN PATENT DOCUMENTS

| | | | |
|---|---|---|---|
| 487201 | 10/1952 | Canada . | |
| 2052925 | 4/1992 | Canada . | |
| 0207921 | 1/1987 | European Pat. Off. . | |
| 0481321 | 4/1992 | European Pat. Off. . | |
| 70273 | 2/1986 | Finland . | |
| 914721 | 4/1992 | Finland . | |
| 0696068 | 8/1953 | United Kingdom | 492/30 |
| 2169381 | 7/1986 | United Kingdom . | |

*Primary Examiner*—Irene Cuda

*Attorney, Agent, or Firm*—Steinberg, Raskin & Davidson, P.C.

[57] ABSTRACT

The center roll in the paper machine is made of a ceramic or metal-ceramic basic material. At least one portion of the center roll is coated or soaked with a polymer coating in order to obtain the desired adhesion properties of the face of the center roll.

20 Claims, 3 Drawing Sheets

FIG. 4
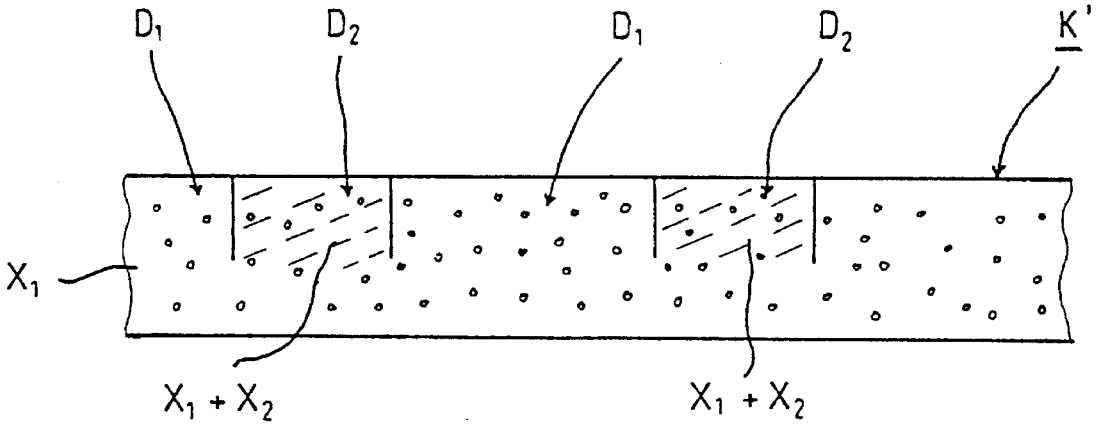
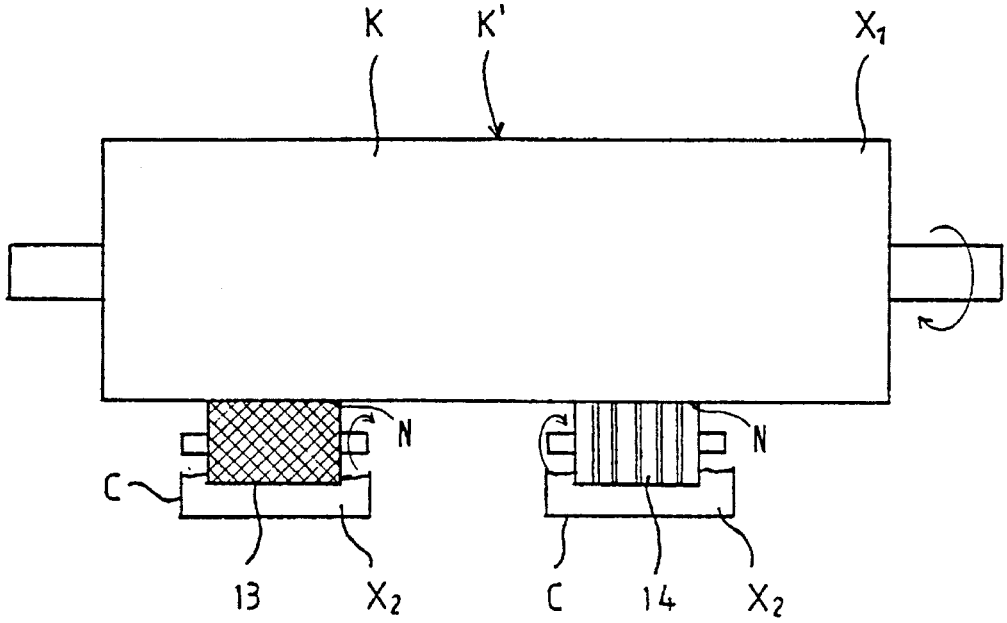
FIG. 3

CENTER ROLL IN THE PRESS OF A PAPER MACHINE

This is a division of application Ser. No. 08/249,844, filed May 26, 1994, now U.S. Pat. No. 5,456,946 which in turn is a continuation of application Ser. No. 08/046,458, filed Apr. 12, 1993.

BACKGROUND OF THE INVENTION

The present invention relates to a method for coating a press roll and in particular a center roll used in the press section of a paper machine. The invention also relates to a center roll formed by the method and used in a press section of a paper machine.

At present, center rolls used in press sections of paper machines are coated with a ceramic. However, when ceramic center rolls are employed in the press section, it is difficult to control the properties of separation and/or adhesion of the paper web.

Impregnation of a ceramic coating with plastic is known in the prior art. However, this technique has been applied so that the whole face of the roll is treated, in which case pores present in the roll face are fully or partly filled with plastic. In such an embodiment, all of the surface properties of the roll are changed, and it is a significant drawback that the desired, advantageous properties of a pure non-impregnated ceramic cannot be utilized.

OBJECTS AND SUMMARY OF THE INVENTION

It is an object of the present invention to provide a new and improved method for coating a center roll used in a press section in order to obtain improved control over the properties of separation and/or adhesion of the web to the center roll.

It is another object of the present invention to provide a new and improved method for coating a roll and a center roll used in a press section in which the drawbacks of the prior art are eliminated.

In view of achieving these objects and others, in the present invention, the center roll is coated in such a manner that the ceramic roll face is partially coated with a plastic only, for example, Teflon-coated. This advantageous coating produces the convenient separation of the web from the roll face. The non-Teflon-coated portions of the roll guarantee an adequate adhesion of the roll face, so that the paper web does not follow, e.g., the pick-up felt after a second nip in the press section.

According to the present invention, the property of the separation and/or adhesion of the web to the web contacting surface of the center roll are adjustable by varying the ratio of the area of coated face to the area of uncoated face. The coating can be carried out, for example, by covering the roll with perforated or grooved tape and by spraying a fluoroplastic into the roll face through the grooves and/or perforations in the tape. The fluoro-plastic may be, e.g., polytetrafluoroethylene (PTFE), co-polymer of tetrafluoroethylene and hexafluoropropylene (FEP), polychlorotrifluoroethylene (PCTFE), perfluoroalkoxy (PFA), and polyvinylidenefluoride (PVDF). After the spraying is finished, the perforated tape is removed, and the plastic is polymerized in an oven. The coating agent may also be applied by means of a raster-faced or grooved roll.

It is possible to manufacture a ceramic center roll of a novel type by treating only a specific circumferential portions specific portion of the roll face by means of the method in accordance with the invention. Owing to the inherent nature of the ceramic coating, a uniform surface structure is obtained as the coating agent is carried by absorption into the porous ceramic or metal-ceramic base material. Preferably, the base ceramic $X_1$ of the center roll K may be an oxide ceramic, such as Zr, Al, Si, Ti, Y, Cr oxide, a carbide ceramic, such as Cr, W, Ti, Nb carbide, or a boride ceramic, such as Fe, Cr, Ti boride, or a mixture or compound of any of these substances. In a preferred embodiment, metals, such as Al, Cr, Ni, Co, may have been alloyed into the above mentioned ceramics.

In another embodiment, it is possible to employ one or several so-called adhesion layers to ensure reliable adhesion of the ceramic or metal-ceramic layer. The adhesion layers are applied under the ceramic or metal-ceramic coating and in contact with the roll body. The adhesion layer is preferably a thin, thermally sprayed metal layer with minimal porosity. The thickness of the ceramic or metal-ceramic coating is from about 0.05 mm to about 4 mm, preferably from about 0.5 mm to about 2 mm.

The invention permits the manufacture of a roll with a roll face providing an adhesion force that varies in the direction of the roll circumference, i.e. in the running direction of the paper web. Thus, the roll face can be selected, e.g., in view of the desired doctoring properties. It is an important feature of a center roll formed by the method in accordance with the invention that the wear of a roll is substantially uniform because the hardness of the coated roll area is substantially equal to the hardness of the uncoated roll area.

In the method in accordance with the invention, the desired portions of the center roll are coated or soaked with a polymer in view of obtaining the desired adhesion properties of the roll face of the center roll.

The center roll in accordance with the invention, and preferably for use in a paper machine press section, comprises a coating layer which consists of a polymer and which has been absorbed into the ceramic or metal-ceramic basic material which constitutes the roll body.

BRIEF DESCRIPTION OF THE DRAWINGS

The following drawings are illustrative of embodiments of the invention and are not meant to limit the scope of the invention as encompassed by the claims.

FIG. 3 illustrates a second preferred embodiment of the center roll and method for coating a center roll in accordance with the invention.

FIG. 4 sectional view of the roll surface of a center roll into which a coating agent has been absorbed.

DETAILED DESCRIPTION OF THE INVENTION

Figure 1:
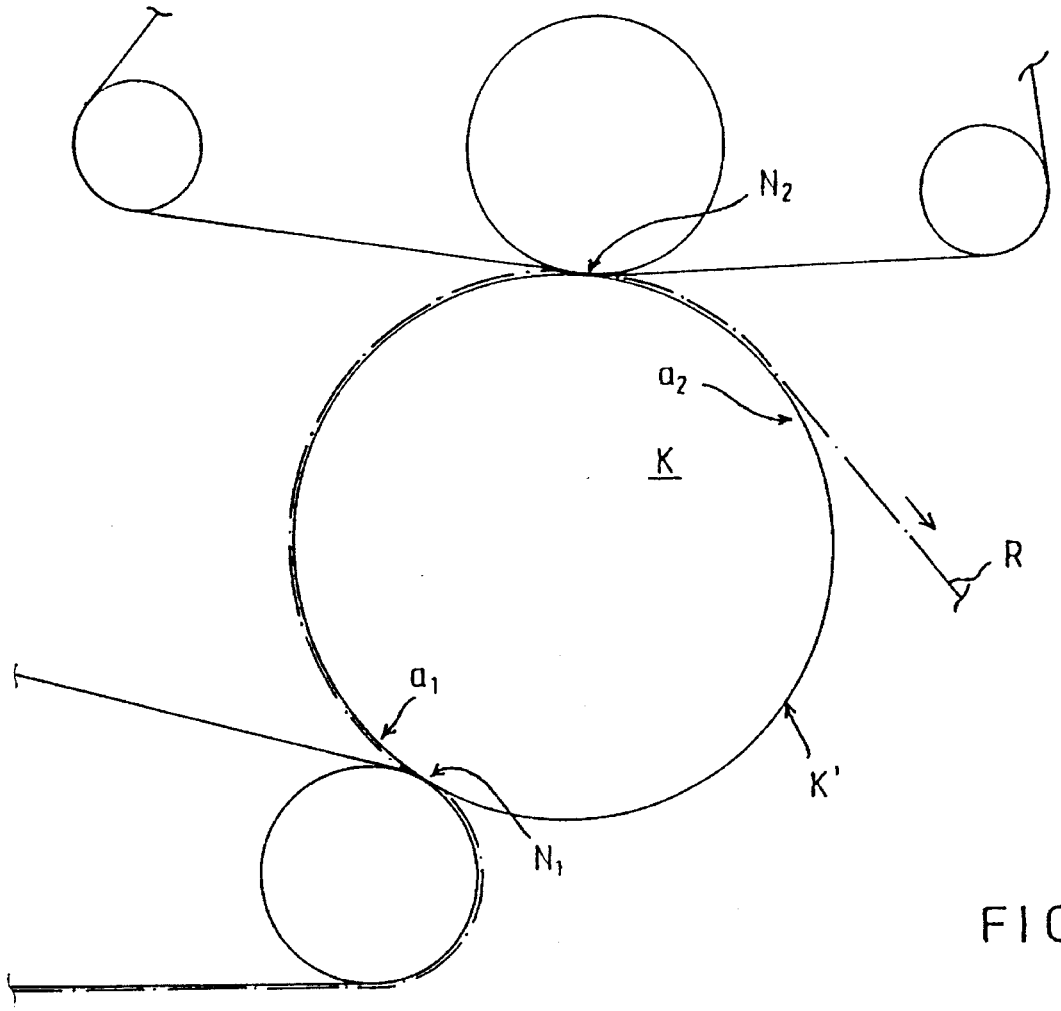
FIG. 1 illustrates the problem areas of the separation and adhesion of the web occurring in the operation of a center roll in a press section of a paper machine.

FIG. 1 is a schematic illustration of a pair of nips $N_1$ and $N_2$ arranged in connection with a center roll K in a press section of a paper machine. A paper web or board R is passed from a wire or felt in nip $N_1$ onto a roll face of the center roll K. The web runs along the surface of the center roll K through nip $N_2$. From nip $N_2$, the web runs further along the roll face K' of the center roll K a distance until the web R is separated from the roll face. It is advantageous that the paper web R adhere to the roll face in an area $a_1$ of the center roll K. Adhesion provided by the roll face of center roll K is important in this area in order to hold the paper web R on the face of the center roll K. In a corresponding manner, the web is guided away from the face of the center roll K in area $a_2$ such that a lower adhesion force is required from the face in order that the paper web should be detached from the roll faces as well as possible. Thus, in the areas $a_1$ and $a_2$, the separation and adhesion properties required from the face K' of the center roll K are contradictory to each other. Therefore, with respect to the center-roll operations, the roll face must be selected separately from case to case depending on the application of the center roll in the press section.

In the method of the invention, a coating $X_2$ for the center roll K is selected variably. Coating $X_2$ is preferably a polymer. In accordance with the present invention, a plastic coating 21 is soaked into the roll face. The plastic coating 21 is preferably a Teflon coating such as polytetrafluoroethylene (PTFE). The coating may also be another fluoro-plastic, such as polychlorotrifluoroethylene (PCTFE), perfluoroalkoxy (PFA), polyvinylidenefluoride (PVDF), or a copolymer of tetrafluoroethylene and hexafluoropropylene.

Figure 2:
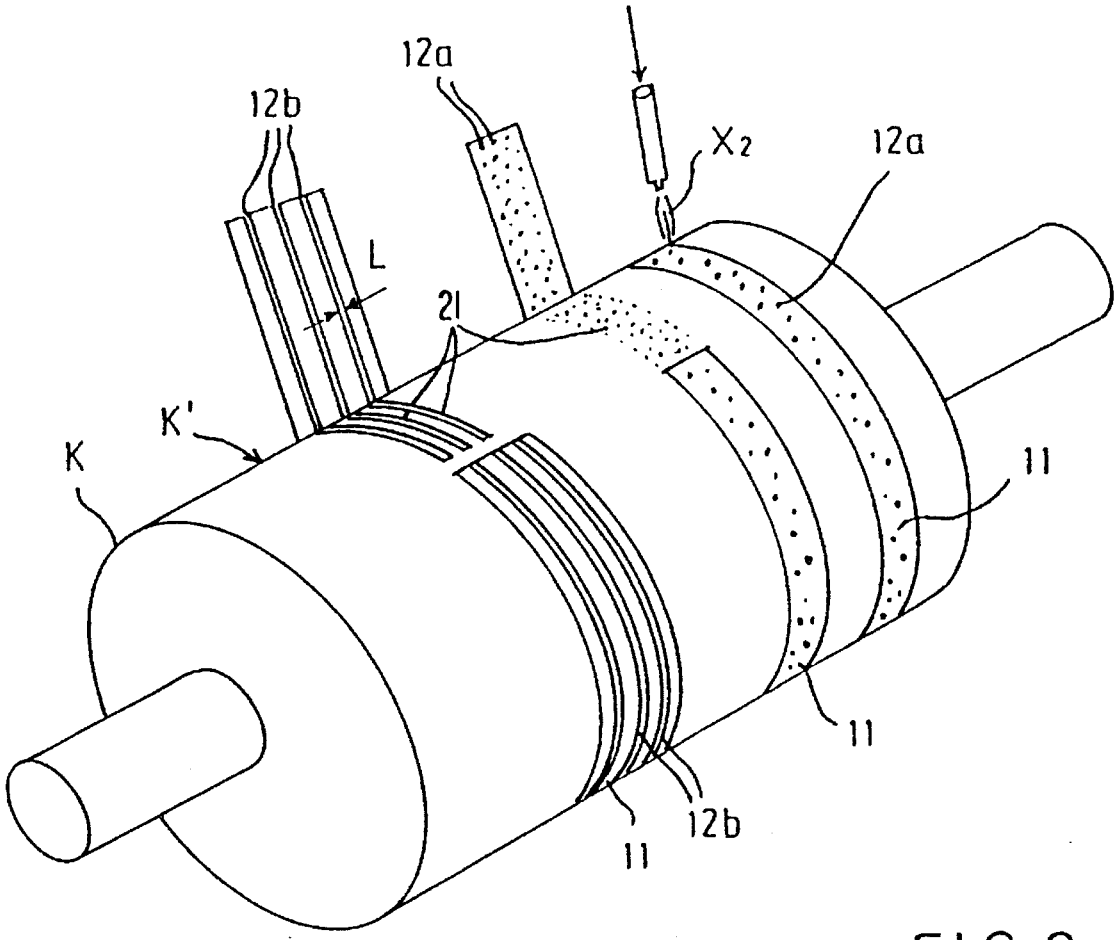
FIG. 2 illustrates a first preferred embodiment of the center roll and method for coating a center roll in accordance with the invention.

As shown in FIG. 2, the coating agent $X_2$ is spread by a coating process such as spraying. As the roll is only partially coated, i.e. only specific circumferential portions of the roll are coated, the portions of the roll that are not to be coated are covered with a tape 11 which is grooved and/or perforated 12*a*, 12*b*. Thus, the coating is applied to a portion only of the circumference of the web-contacting surface of the center roll such that at least one complete circumferential portion along the axial length of the center roll is not coated. FIG. 2 shows the stage in the method in which the tapes 11 are removed after the coating agent has been sprayed onto the roll surface over the portions selected to be coated. By varying the perforations 12*a* and/or grooves 12*b* in the tape, the roll face can be provided with the desired patterned form and, thus with the desired adhesion force.

The adhesion force of the roll can be varied, for example, across the length of the roll, by providing that the ratio of the uncoated portions of the roll face to coated portions of the roll face is varied. This ratio is adjustable, e.g., by varying the size of the perforations 12*a* in the tape 11 and/or by varying the spacing of the perforations in the tape 11. It is also possible to vary the groove width (L) and/or the spacing of the grooves 12*b* in the tape 11. The tape 11 may be perforated before and/or after it is applied onto the roll face. After the coating stage is completed, the tape 11 is removed and the coating is polymerized by, e.g., heating the roll in an oven.

FIG. 3 illustrates another embodiment of the coating in accordance with the invention wherein the same reference numerals indicated the same elements as set forth and described in the embodiments of FIGS. 1 and 2. The coating agent is applied to the roll face K' of the center roll K by means of a rasterized and/or grooved roll 13,14. The center roll K is rotated in contact with the rasterized rolls 13,14. The rasterized rolls 13,14 are placed partly in a basin C that contains the coating agent $X_2$. The coating agent $X_2$ adheres to a face of the rasterized rolls 13,14. As the rolls K,13,14 revolve, the coating agent is transferred to an application area on the face K' of the center roll K from the face of the rasterized roll 13,14 in a nip N defined between the rasterized rolls 13,14 and the center roll K.

It is possible to manufacture rolls having an adhesion force which is higher in the middle area of the roll face than at the edges of the roll by means of the method of the invention. It is also possible to manufacture rolls whose face has a higher adhesion in the lateral areas of the roll as compared with the middle area of the roll. The coating form and the coating area can be chosen in accordance with the requirements imposed by the operation of the roll in each particular case for each specific press section arrangement.

FIG. 4 is a sectional view of the face of a center roll K in accordance with the invention wherein the same reference numerals indicated the same elements as set forth and described in the embodiments of FIGS. 1–3. In FIG. 4, a material $X_1$ of an area $D_1$ consists of a ceramic basic material into which the coating agent $X_2$ has been impregnated or soaked in an area D2. The base-material ceramic $X_1$ may be an oxide ceramic, such as Zr, Al, Si, Ti, Y, Cr oxide, a carbide ceramic, such as Cr, W, Ti, Nb carbide, a boride ceramic, such as Fe, Cr, Ti boride, or a mixture or compound of any of these ceramic materials. Metals, such as Al, Cr, Ni, Co, may be alloyed into the above ceramics. The coating agent $X_2$ absorbed into the ceramic roll face is preferably a fluoro-plastic, such as polytetrafluoroethylene (PTFE), a co-polymer of tetrafluoroethylene and hexafluoropropylene (FEP), polychlorotrifluoroethylene (PCTFE), perfluoroalkoxy (PFA), or polyvinylidenefluoride (PVDF).

The use of a coating method in accordance with the invention permits variation of the surface properties on a very small scale, i.e. very fine adjustments are possible. In addition, it is possible to provide the roll face of the center roll with a desired pattern form in which the roll face and the coating-agent face alternate in the desired manner. The wear of the center roll K in accordance with the invention is substantially uniform because the hardness of the materials $X_1+X_2$ in the coated area $D_2$ of the roll is substantially equal to the hardness of the basic material $X_1$ in the uncoated area $D_1$ of the roll.

The present invention describes the use of a coating method for coating a center roll of a press section in a paper machine. As known in the art, the center roll is preferably solid. However, the present invention may also be used for a roll having a roll mantle of a base material which is a ceramic or metal-ceramic compound. The coating agent in accordance with the invention is then applied to the roll mantle.

The examples provided above are not meant to be exclusive. Many other variations of the present invention would be obvious to those skilled in the art, and are contemplated to be within the scope of the appended claims.

I claim:

1. A center roll having a roll face of a ceramic or metal-ceramic base material having a web-contacting surface, a first region of the web-contacting surface being coated by applying a coating agent thereto, and a second region of the web-contacting surface being maintained in an uncoated state such that desired adhesion properties of a paper web or board running over the web-contacting surface are obtained, the coating agent comprising a polymer absorbed into the ceramic or metal-ceramic base material.

2. The center roll of claim 1, wherein the coating agent is a fluoro-plastic.

3. The center roll of claim 2, wherein the coating agent is a co-polymer of tetrafluoroethylene and hexafluoropropylene, polychlorotrifluoroethylene, perfluoroalkoxy, or polyvinylidenefluoride.

4. The center roll of claim 1, wherein the coating agent is absorbed into at least one circumferential portion of the web-contacting surface of the center roll to form a pattern form such that uncoated circumferential portions of the web-contacting surface alternate with coated portions of the web-contacting surface.

5. The center roll of claim 1, wherein the coating agent is applied onto the web-contacting surface such that the amount of the coating agent per area of the roll varies over the length of the roll, and adhesion force of the web-contacting surface being affected by the ratio of the area of the first coated region to the area of the second uncoated region.

6. The center roll of claim 1, wherein the coating agent is applied onto the roll face by a raster roll in a nip defined between the raster roll and the center roll.

7. A center roll for use in a press section of a paper machine, comprising a roll face of a ceramic or metal-ceramic base material having a web-contacting surface, and a coating agent applied to a first region of the web-contacting surface of the center roll such that a second region of the web-contacting surface is maintained in an uncoated state.

8. The roll of claim, wherein the adhesion force between the roll face and the web is adjusted by varying the proportion of the area of the coated portions to the area of the uncoated portions of the roll face.

9. A center roll for use in a press section of a paper machine manufactured by providing the center roll with a ceramic or metal-ceramic base material, applying a polymer coating to a first region of a web-contacting surface of the center roll, and maintaining a second region of the web-contacting surface in an uncoated state.

10. The center roll of claim 1, wherein said first region consists of a portion only of a circumference of the web-contacting surface of the center roll, said second region consisting of at least one complete circumferential portion along the axial length of the center roll.

11. The center roll of claim 1, wherein said first region is coated and said second region is maintained uncoated such that adhesion properties of the web-contacting surface to the web vary in an axial direction of the center roll.

12. The center roll of claim 11, wherein said first region comprises at least one circumferential portion of the web-contacting surface and said second region comprises at least one circumferential portion of the web-contacting surface.

13. The center roll of claim 1, wherein said center roll is used in a press section of a paper machine in which the paper or board web runs over said center roll.

14. The center roll of claim 7, wherein the coating agent is soaked into the base material and comprises polytetrafluoroethylene.

15. The center roll of claim 7, wherein a coating pattern is produced by covering at least one circumferential portion of the web-contacting surface with a tape and spraying the coating agent onto circumferential portions of the web-contacting surface that are not covered by the tape.

16. The center roll of claim 9, wherein the coating agent is soaked into the base material and comprises polytetrafluoroethylene.

17. The center roll of claim 9, wherein a coating pattern is produced by covering at least one circumferential portion of the web-contacting surface with a tape and spraying the coating agent onto circumferential portions of the web-contacting surface that are not covered by the tape.

18. The center roll of claim 1, wherein the web-contacting surface has a substantially uniform surface and the polymer is completely absorbed into the base material.

19. A center roll having a roll face of a ceramic or metal-ceramic base material having a web-contacting surface, a first region of the web-contacting surface being coated by soaking a coating agent into the base material, and a second region of the web-contacting surface being maintained in an uncoated state such that desired adhesion properties of a paper web or board running over the web-contacting surface are obtained, the coating agent comprising a polytetrafluoroethylene.

20. A center roll having a roll face of a ceramic or metal-ceramic base material having a web-contacting surface, a first region of the web-contacting surface being coated by applying a coating agent thereto, and a second region of the web-contacting surface being maintained in an uncoated state such that desired adhesion properties of a paper web or board running over the web-contacting surface are obtained, the coating agent comprising a polymer absorbed into the ceramic or metal-ceramic base material, a coating pattern of the web-contacting surface being produced by covering at least one circumferential portion of the web-contacting surface with a tape and spraying the coating agent onto circumferential portions of the web-contacting surface that are not covered by the tape.

* * * * *